US010037583B2

(12) United States Patent
Bharti et al.

(10) Patent No.: US 10,037,583 B2
(45) Date of Patent: Jul. 31, 2018

(54) SYSTEMS AND METHODS FOR ANALYZING SOCIAL NETWORK CONTENT OF A KEY INFLUENCER

(71) Applicant: Infosys Limited, Bangalore (IN)

(72) Inventors: Shaurabh Bharti, Lucknow (IN); Jai Ganesh, Munger (IN); Nishtha Srivastava, Bangalore (IN)

(73) Assignee: Infosys Limited, Bangalore (IN)

( * ) Notice: Subject to any disclaimer, the term of this patent is extended or adjusted under 35 U.S.C. 154(b) by 164 days.

(21) Appl. No.: 14/493,664

(22) Filed: Sep. 23, 2014

(65) Prior Publication Data

US 2015/0169728 A1 Jun. 18, 2015

(30) Foreign Application Priority Data

Dec. 17, 2013 (IN) ..... 5876/CHE/2013

(51) Int. Cl.
*G06Q 50/00* (2012.01)

(52) U.S. Cl.
CPC ..... *G06Q 50/01* (2013.01)

(58) Field of Classification Search
CPC ..... G06F 17/30598; G06Q 50/01
See application file for complete search history.

(56) References Cited

U.S. PATENT DOCUMENTS

2008/0104225 A1* 5/2008 Zhang ..... H04L 67/36 709/224
2013/0179806 A1* 7/2013 Bastide ..... G06F 17/30867 715/760
2015/0120782 A1* 4/2015 Kim ..... G06F 17/3053 707/798
2016/0191447 A1* 6/2016 Firat ..... H04L 51/32 709/204

OTHER PUBLICATIONS

Heer J. and Boyd D. Vizster: Visualizing Online Social Networks. In Proceedings of the Proceedings of the 2005 IEEE Symposium on Information Visualization, IEEE Computer Society, Oct. 2005.*
Newman M.E.J.: Analysis of weighted networks. Physical Review E 70M 056131, Nov. 2004.*

* cited by examiner

*Primary Examiner* — Mark D Featherstone
*Assistant Examiner* — Ranjit P Doraiswamy
(74) *Attorney, Agent, or Firm* — LeClairRyan PLLC

(57) ABSTRACT

This technology relates to a method, non-transitory computer readable medium, and influencer analyzing computing device for analyzing content associated with one or more influencers of at least one social network. This technique involves identifying key influencers of at least one social network with respect to a topic of interest. Thereafter, an overall topic cloud and an influencer topic cloud for each key influencer is created and analyzed. The overall topic cloud and an influencer topic cloud are compared to cross-verify if the identification of the key influencers is correct. After that, volume of social interaction of the key influencers with respect to the topic of interest are determined and visualized.

15 Claims, 4 Drawing Sheets

SYSTEMS AND METHODS FOR ANALYZING SOCIAL NETWORK CONTENT OF A KEY INFLUENCER

CROSS REFERENCE TO RELATED APPLICATION

This application is a continuation-in-part of U.S. patent application Ser. No. 13/716,045 filed on 14 Dec., 2012, now U.S. publication number US20130166540 A1 which claims the priority to Indian patent application number 4597/CHE/2011, filed on Dec. 27, 2011, which is incorporated herein by reference.

This application claims the benefit of Indian Patent Application No. 5876/CHE/2013 filed Dec. 17, 2013, which is hereby incorporated by reference in its entirety.

FIELD

The invention relates generally to analyze social network content, and in particular, to a system and method for analyzing social network content of a key influencer.

BACKGROUND

The World Wide Web is a vast repository of information that connects people, providing them access to millions of web resources via the Internet. Social Networks are growing exponentially, which presents challenges for enterprises who want to monitor and mine these social networks. There is market opportunity for players who can mine intelligence out of social media. Social Network Analysis (SNA) relates to mapping, understanding, and analyzing interactions across a set of people. Social networks, both formal as well as informal can foster knowledge sharing among participants. The exchanges that take place in social networking environments go beyond providing direct value to the user. It fosters collaboration among participants and can lead to aggregation of highly influential content and ideas within various types of social media. Content generated in social networking environments would include discussion threads, logs of chat room conversations, contents of blogs, and any other content posted by users. This collection of content comes from original sources (creation of the user), referenced sources (material cited and presented by users) and aggregated content (collection of material assembled in a unique manner). As long as members continue to add useful or relevant content to the group, the positive network externalities would draw new members to the group.

The accumulated content and ideas within successful social networking environments thus becomes an aggregation of the collective intelligence of the user community participating in those sites. The accumulated content can be considered as an asset that has value, which can be tapped through the right types of analyses. This asset has potential value to both owners of the sites as well as the organizations whose products and services being discussed. It presents significant implications for enterprises wanting to leverage social networks to draw insights and inferences on user participation and preferences expressed in networks. Thus, to monitor and analyze the content posted in a social network by a key influencer becomes very important to enhance decision making ability of any organization.

SUMMARY

According to the present embodiment, a method for analyzing content associated with one or more influencers of at least one social network is disclosed.

The method includes identifying one or more key influencers with respect to a topic of interest in at least one social network. Thereafter, an influencer topic cloud for each of the one or more key influencers and an overall topic cloud for the topic of interest are created. The identification of the one or more key influencers is cross-verified by comparing one or more attributes of the influencer topic cloud with the overall topic cloud. Further, volume of social interaction of the one or more key influencers with respect to the topic of interest is determined, wherein the volume of the social interaction comprises interaction with peers and the interaction with followers. Finally, the volume of the social interaction of the one or more key influencers is visualized.

In an additional embodiment, a system for analyzing content associated with one or more influencers of at least one social network is disclosed. The system includes a key influencer identifier, a topic cloud creator, a cross-verifier, a social interaction determiner and a visualizer. The key influencer identifier is configured for identifying one or more key influencers with respect to a topic of interest in at least one social network. The topic cloud creator is configured for creating an influencer topic cloud for each of the one or more key influencers and an overall topic cloud for the topic of interest. The cross-verifier is configured for cross-verifying the identification of the one or more key influencers by comparing one or more attributes of the influencer topic cloud with the overall topic cloud. The social interaction determiner is configured for determining volume of social interaction of the one or more key influencers with respect to the topic of interest, wherein the volume of the social interaction comprises interaction with peers and the interaction with followers. Finally, the visualizer is configured for visualizing the volume of the social interaction of the one or more key influencers on a display of a computing device.

In another embodiment, a computer readable storage medium for analyzing content associated with one or more influencers of at least one social network is disclosed. The computer readable storage medium which is not a signal stores computer executable instructions for identifying one or more key influencers with respect to a topic of interest in at least one social network, creating an influencer topic cloud for each of the one or more key influencers and an overall topic cloud for the topic of interest, cross-verifying the identification of the one or more key influencers by comparing one or more attributes of the influencer topic cloud with the overall topic cloud, determining volume of social interaction of the one or more key influencers with respect to the topic of interest, wherein the volume of the social interaction comprises interaction with peers and the interaction with followers and visualizing the volume of the social interaction of the one or more key influencers.

DRAWINGS

Various embodiments of the invention will, hereinafter, be described in conjunction with the appended drawings. There is no intention to limit the scope of the invention to such blocks or objects, or to any particular technology. Instead these simplified diagrams are presented by way of illustration to aid in the understanding of the logical functionality of one or more aspects of this technology and is not presented by way of limitation.

DETAILED DESCRIPTION

The foregoing has broadly outlined the features and technical advantages of the present disclosure in order that the detailed description of the disclosure that follows may be better understood. Additional features and advantages of this technology will be described hereinafter which form the subject of the claims of the disclosure. It should be appreciated by those skilled in the art that the conception and specific embodiment disclosed may be readily utilized as a basis for modifying or designing other structures for carrying out the same purposes of this technology. It should also be realized by those skilled in the art that such equivalent constructions do not depart from the spirit and scope of the disclosure as set forth in the appended claims. The novel features which are believed to be characteristic of this technology, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of this technology.

Exemplary embodiments of the present invention provide a system and method for analyzing content associated with one or more influencers of at least one social network. This involves identifying key influencers of at least one social network with respect to a topic of interest. Thereafter, an overall topic cloud and an influencer topic cloud for each key influencer is created and analyzed. The overall topic cloud and an influencer topic cloud are compared to cross-verify if the identification of the key influencers is correct. After that, volume of social interaction of the key influencers are determined and visualized.

Figure 1:
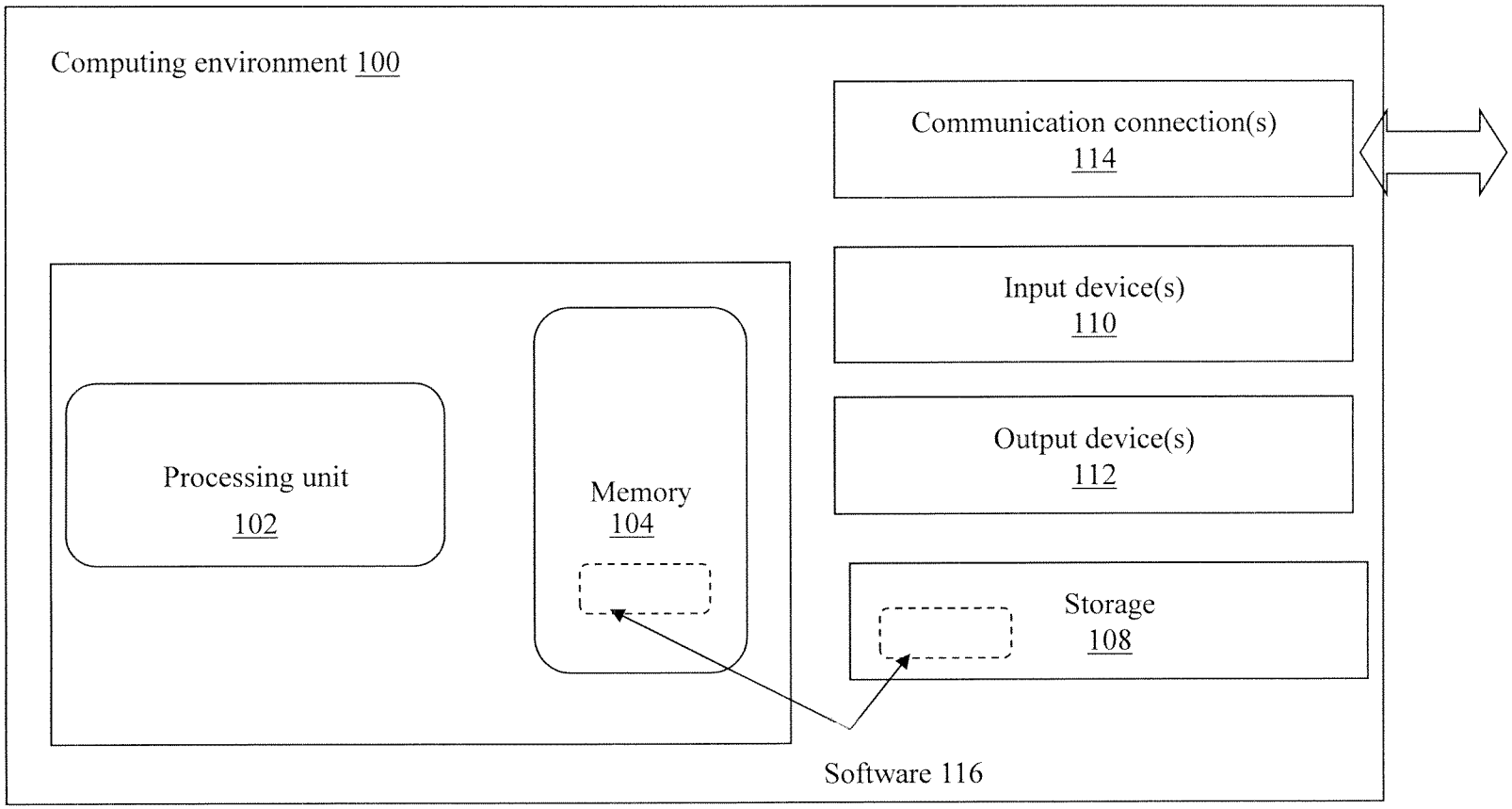
FIG. 1 is a computer architecture diagram illustrating a computing system capable of implementing the embodiments presented herein.

FIG. 1 illustrates an example of a suitable computing environment 100 in which all embodiments, techniques, and technologies of this invention may be implemented. The computing environment 100 is not intended to suggest any limitation as to scope of use or functionality of the technology, as the technology may be implemented in diverse general-purpose or special-purpose computing environments. For example, the disclosed technology may be implemented using a influencer analyzing computing device (e.g., a server, desktop, laptop, hand-held device, mobile device, PDA, etc.) comprising a processing unit, memory, and storage storing computer-executable instructions implementing the service level management technologies described herein. The disclosed technology may also be implemented with other computer system configurations, including hand held devices, multiprocessor systems, microprocessor-based or programmable consumer electronics, network PCs, minicomputers, mainframe computers, a collection of client/server systems, and the like.

With reference to FIG. 1, the computing environment 100 includes at least one central processing unit 102 and memory 104. The central processing unit 102 executes computer-executable instructions. In a multi-processing system, multiple processing units execute computer-executable instructions to increase processing power and as such, multiple processors can be running simultaneously. The memory 104 may be volatile memory (e.g., registers, cache, RAM), non-volatile memory (e.g., ROM, EEPROM, flash memory, etc.), or some combination of the two. The memory 104 stores software 116 that can implement the technologies described herein. A computing environment may have additional features. For example, the computing environment 100 includes storage 108, one or more input devices 110, one or more output devices 112, and one or more communication connections 114. An interconnection mechanism (not shown) such as a bus, a controller, or a network, interconnects the components of the computing environment 100. Typically, operating system software (not shown) provides an operating environment for other software executing in the computing environment 100, and coordinates activities of the components of the computing environment 100.

Figure 2:
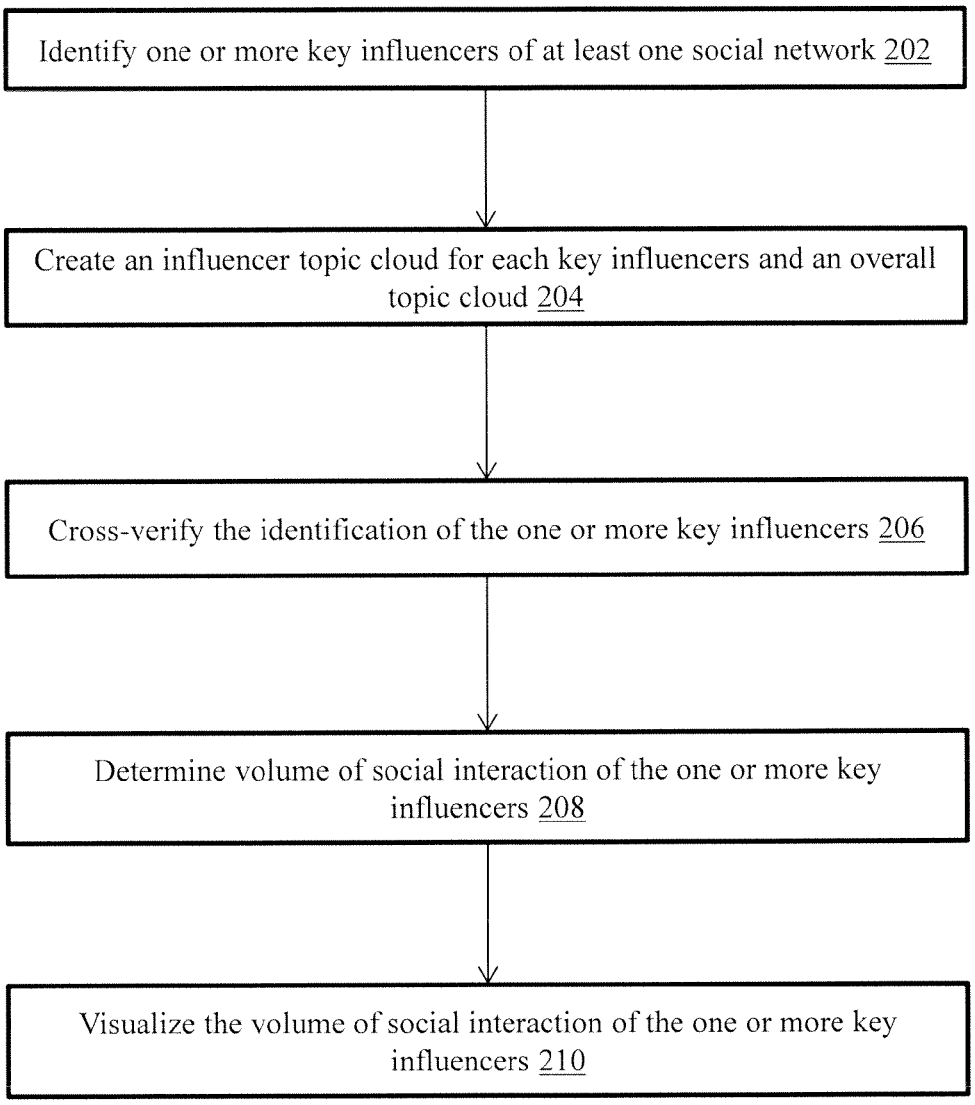
FIG. 2 is a flowchart, illustrating a method for analyzing content associated with one or more influencers of at least one social network, in accordance with an embodiment of the present invention.

FIG. 2 is a flowchart, illustrating a method for analyzing content associated with one or more influencers of at least one social network, in accordance with an embodiment of the present invention. One or more key influencers of at least one social network are identified with respect to a topic of interest, as in step 202. The one or more key influencers can be identified based on the method described in U.S. patent application Ser. No. 13/716,045 or any other method known by the skilled person in this art. After identifying the one or more key influencers, an overall topic cloud and an influencer topic cloud for each of the one or more key influencers are created, as in step 204. An influencer is generally active over a variety of topics. Depending upon what is popular at a time, it could vary from movies to gadgets to politics or sports etc. It is important that influencer holds a strong activity on the topic in question; it is also helpful that influencer is active in other topics too, with good share of influence. Old tweets of influencer over a period are analyzed to create a set of topics, presented as Clouds, which would reflect all the areas in which the influencer has been active, with influence weights. There can be two types of influencer topic cloud as follows:

a) Cloud of related topics with weights: A general topic is broadly a collection of multiple related topics. If influencer has strong reputation in the topic in question, it may exert stronger influence by creating and participating in discussions on related topics too. Influencer may avoid to be confined to a particular topic in this way and may acquire a larger reputation.

b) Cloud of general topics with weights: Often topics of interest may not be popular at a time. Influencer may participate in other popular topics and exert influence on them. Influencer may maintain reputation in this way for a longer period of time. This also broadens its reputation upon a larger set of topics.

Referring back to FIG. 2, all the topics or keywords related to the topic of interest together form an overall topic cloud. The overall topic cloud and an influencer topic cloud are compared with respect to one or more attributes to cross-verify if the identification of the key influencers is correct, as in step 206. An overall topic cloud contains posts from all users of the social network with higher or lesser significance. Usually, this is the targeted mass of influence. Lesser significant influencers are abundant but hold a passive presence in an overall topic cloud, creating a mass sentiment around the topic of interest. The influencer topic cloud is compared with the overall topic cloud to match the abundance with significance. The influencer topic cloud having more common attributes to the overall topic cloud represents higher strength of lightening. A volume of social interaction of the one or more key influencers is determined with respect to the topic of interest, as in step 208. The volume of social interaction of the one or more key influencers includes interaction with peers and interaction with followers.

a) Interaction with peers: When influencers tweet, they are responded and mentioned by other users with their view. These interactions are further continued by influencers and their peers.

b) Interaction with followers: followers of influencers create their own interaction circle and are further extended by their followers. This creates a depth in interaction pattern upon the topic or tweet influencer started. Depth is higher if larger set of followers recommend or re-tweet influencers tweet.

Figure 3:
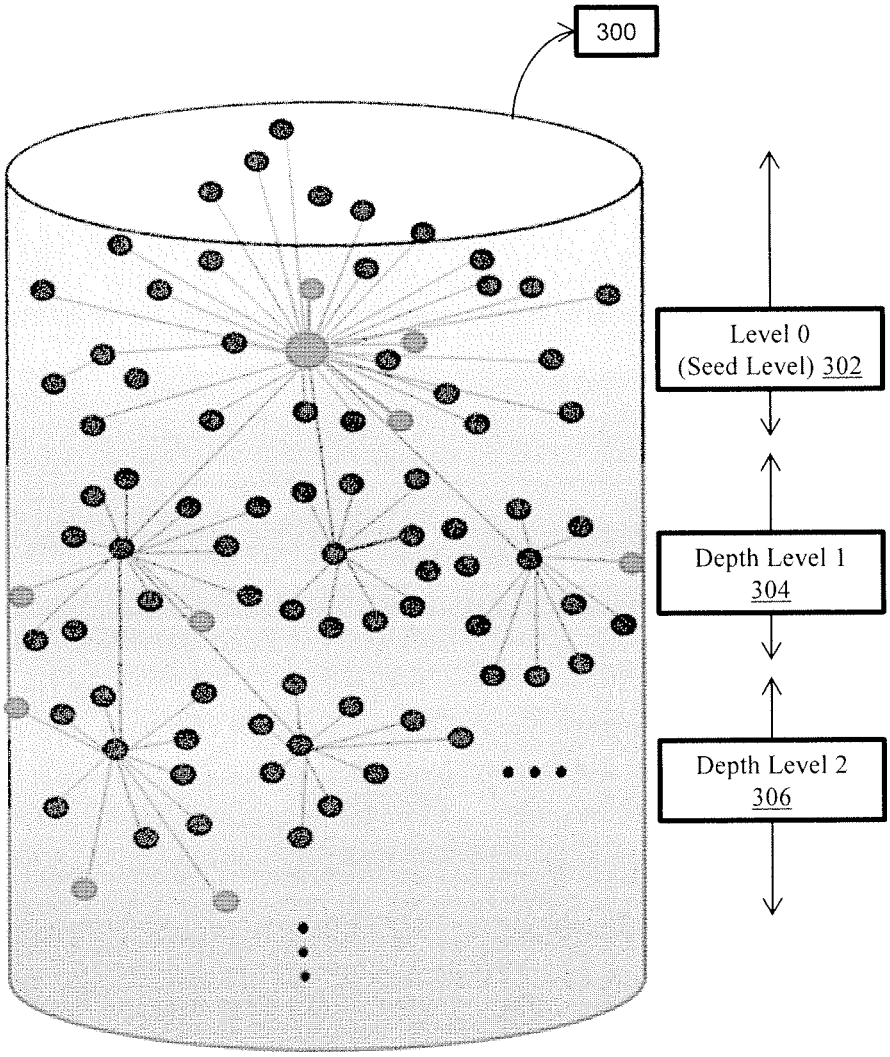
FIG. 3 is an exemplary visualization of volume of social interaction of one or more key influencers, in accordance with an embodiment of the present invention.

The volume of the interaction with followers and peers gives an insight into overall effect of influencers tweet in a social network. The volume of the social interaction of the one or more key influencers is visualized, as in step 210. FIG. 3 is an exemplary visualization of volume of social interaction of one or more key influencers, in accordance with an embodiment of the present invention. Central node in the level 0 302 represents the influencer. All other nodes represent users/peers in the network involved in the interaction. Peers having excessive interaction have shorter but thicker edges. Peers having stronger interaction circles of their own have longer edges. Each depth level (304 and 306) in the well represents interaction circles. Volume of the interaction with followers and peers gives an insight into overall effect of influencer's tweet in a social network.

This technology also visualizes network data, profile data and content data of the one or more influencers. The network data may include, but is not limited to, connection between friends and followers, lists, verification and membership of the one or more key influencers. Friends influence the user with their views, while user influences its followers with its views. Both are important for a constructive communication in social network. They also help in further propagation of the viewpoint to a larger network. User is tagged by other users in lists according to their preferences. They tag the user with list names in the process. These tags provide insight into various ways the user influence upon other users. A verified member as well as an old time member influence stronger on followers. Personal data may include but is not limited to gender, age, race, geography, language, profession and personal interest of the one or more key influencers. Content data may include but is not limited to attributes of Posts (text, video, and photo) like time, size, search relevance, Shares, Comments/responses and so on.

According to an embodiment of this technology, the influencer topic cloud of the one or more key influencers are compared with each other for clustering the key influencers. Influencers are arranged based on the strength of lightening between two influencers. This strength is determined based on similarity between attributes of two influencer topic clouds. The one or more attributes may include but are not limited to network data, profile data and content data of the one or more influencers, size of a keyword based on its frequency, classification based on one or more related or unrelated topics in question, a peripheral ring around the keyword capturing share of the one or more influencers, classification based on age of the content or combination thereof.

Figure 4:
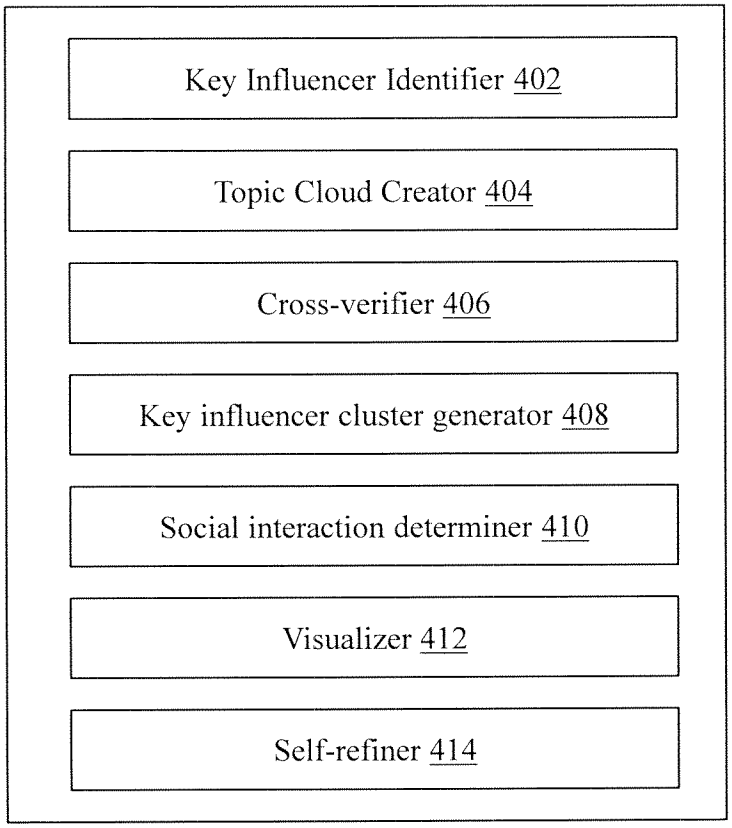
FIG. 4 is a block diagram illustrating a system for analyzing content associated with one or more influencers of at least one social network, in accordance with an embodiment of the present invention.

FIG. 4 is a block diagram illustrating a system for analyzing content associated with one or more influencers of at least one social network, in accordance with an embodiment of the present invention. The system includes a key influencer identifier 402, a topic cloud creator 404, a cross-verifier 406, a key influencer cluster generator 408, a social interaction determiner 410, a visualizer 412 and a self-refiner 414. The influencer identifier 402 is configured for identifying one or more key influencers with respect to a topic of interest in at least one social network. The topic cloud creator 404 is configured for creating an influencer topic cloud for each of the one or more key influencers and an overall topic cloud for the topic of interest. There can be two types of influencer topic cloud and those are Cloud of related topics with weights and Cloud of general topics with weights which have been discussed in detail with reference to FIG. 2 step 204. The cross-verifier 406 is configured for cross-verifying the identification of the one or more key influencers by comparing one or more attributes of the influencer topic cloud with the overall topic cloud. The key influencer cluster generator 408 is configured for generating cluster of the one or more key influencers by comparing the influencer topic cloud with each other based on one or more attributes. The one or more attributes are mentioned with respect to FIG. 2. The social interaction determiner 410 is configured for determining volume of social interaction of the one or more key influencers with respect to the topic of interest, wherein the volume of the social interaction comprises interaction with peers and the interaction with followers. The visualizer 412 is configured for visualizing the volume of the social interaction of the one or more key influencers on a display of a computing device. FIG. 3 is an exemplary visualization of volume of social interaction of one or more key influencers, in accordance with an embodiment of the present invention. In accordance with an embodiment of this technology, the visualizer further visualizes network data, profile data and content data of the one or more influencers. The details about network data, profile data and content data are described with reference to FIG. 2. The self-refiner 414 is configured for refining the system based on preferences and feedback of one or more users. Self-refinement of the system may depend on the following:

a) End user inputs: Out of all the user inputs (user inputs may include topics, priority for topics, time span, geography, language and so on) end-user may choose to give only a subset of all inputs which seem necessary to him. User inputs can be recorded over a time. Based on this data, user inputs in the system can be modified, deleted or even added.

b) Rate users: End-users can rate/recommend the influencers. This would be useful in future searches as the influencers who had been recommended by end-users in past will have certain amount of more probability of emerging as strong influencer.

c) Rate overall results: End users can rate the overall results of the system whether they found it to be useful, relevant or not. If there's lot of feedback from the end-users not liking the overall results, then steps should be taken to re work upon the internal logic used by the system to identify influencers.

d) Filter parameters: The system has a provision of filtering some of the parameters so that end-users can view a refined result set. Again in this case end-user's activity of filtering can be recorded (their choice of filter parameters selected) and the filter parameters can be modified, deleted, added accordingly.

e) Strike out parameters: Removing a parameter signifies its irrelevance or insignificance for a particular search results. It can help in setting weights appropriately to respective attributes of users and tweets.

The above mentioned description is presented to enable a person of ordinary skill in the art to make and use the invention and is provided in the context of the requirement for obtaining a patent. Various modifications to the preferred embodiment will be readily apparent to those skilled in the art and the generic principles of the present invention may be applied to other embodiments, and some features of the present invention may be used without the corresponding use of other features. Accordingly, the present invention is not intended to be limited to the embodiment shown but is to be accorded the widest scope consistent with the principles and features described herein.

We claim:

1. A method for analyzing content associated with social network influencers, the method comprising:

identifying, by an influencer analyzing computing device, key influencers with respect to a topic of interest in at least one social network;

creating, by the influencer analyzing computing device, an influencer topic cloud for each of the key influencers and an overall topic cloud for the topic of interest, wherein each of the influencer topic clouds comprises at least one of a cloud of related topics with weights or a cloud of general topics with weights;

cross-verifying, by the influencer analyzing computing device, the identification of the key influencers, the cross-verifying comprising at least comparing one or more attributes of each of the influencer topic clouds with the overall topic cloud;

determining, by the influencer analyzing computing device, a volume of social interaction of the key influencers with respect to the topic of interest, wherein the volume of the social interaction comprises interaction with peers and interaction with followers; and generating, by the influencer analyzing computing device, a visualization of the volume of the social interaction of the key influencers.

2. The method as claimed in claim 1, further comprising clustering, by the influencer analyzing computing device, the key influencers, the clustering comprising at least comparing the influencer topic clouds with each other based on the one or more attributes.

3. The method as claimed in claim 2, wherein the one or more attributes comprise network data, profile data and content data of the key influencers, size of a keyword based on its frequency, classification based on one or more related or unrelated topics in question, or classification based on age of the content.

4. The method as claimed in claim l, wherein the visualizing further comprises displaying a visualization of network data, profile data, or content data of at least a subset of the key influencers.

5. A influencer analyzing computing device, comprising a processor and a memory coupled to the processor which is configured to be capable of executing programmed instructions comprising and stored in the memory to:

identify key influencers with respect to a topic of interest in at least one social network;

create an influencer topic cloud for each of the key influencers and an overall topic cloud for the topic of interest, wherein each of the influencer topic clouds comprises at least one of a cloud of related topics with weights or a cloud of general topics with weights;

cross-verify the identification of the key influencers, the cross-verifying comprising at least comparing one or more attributes of each of the influencer topic clouds with the overall topic cloud;

determine a volume of social interaction of the key influencers with respect to the topic of interest, wherein the volume of the social interaction comprises interaction with peers and interaction with followers; and generate a visualization of the volume of the social interaction of the key influencers.

6. The influencer analyzing computing device as claimed in claim 5, wherein the processor coupled to the memory is further configured to be capable of executing at least one additional programmed instruction comprising and stored in the memory to cluster the key influencers comprising at least comparing the influencer topic clouds with each other based on the one or more attributes.

7. The influencer analyzing computing device as claimed in claim 6, wherein the one or more attributes comprise network data, profile data and content data of the key influencers, size of a keyword based on its frequency, classification based on one or more related or unrelated topics in question, or classification based on age of the content.

8. The influencer analyzing computing device as claimed in claim 5, wherein the processor coupled to the memory is further configured to be capable of executing at least one additional programmed instruction comprising and stored in the memory to display a visualization of network data, profile data, or content data of at least a subset of the key influencers.

9. A non-transitory computer readable medium having stored thereon instructions for analyzing content associated with social network influencers comprising executable code which when executed by a processor, causes the processor to perform steps comprising:

identifying key influencers with respect to a topic of interest in at least one social network;

creating an influencer topic cloud for each of the key influencers and an overall topic cloud for the topic of interest, wherein each of the influencer topic clouds comprises at least one of a cloud of related topics with weights or a cloud of general topics with weights;

cross-verifying the identification of the key influencers, the cross-verifying comprising at least comparing one or more attributes of each of the influencer topic clouds with the overall topic cloud;

determining a volume of social interaction of the key influencers with respect to the topic of interest, wherein the volume of the social interaction comprises interaction with peers and interaction with followers; and generating a visualization of the volume of the social interaction of the key influencers.

10. The non-transitory computer readable medium as claimed in claim 9, further having stored thereon at least one additional instruction that when executed by the processor cause the processor to perform at least one additional step comprising clustering the key influencers, the clustering comprising at least comparing the influencer topic clouds with each other based on the one or more attributes.

11. The non-transitory computer readable medium as claimed in claim 10, wherein the one or more attributes comprise network data, profile data and content data of the key influencers, size of a keyword based on its frequency, classification based on one or more related or unrelated topics in question, or classification based on age of the content.

12. The non-transitory computer readable medium as claimed in claim 9, wherein the visualizing further comprises displaying a visualization of network data, profile data, or content data of at least a subset of the key influencers.

13. The method as claimed in claim 1, further comprising refining, by the influencer analyzing computing device, the generated visualization of the volume of the social interaction based on a received user input.

14. The influencer analyzing computing device as claimed in claim 5, wherein the processor coupled to the memory is further configured to be capable of executing at least one additional programmed instruction comprising and stored in the memory to refine the generated visualization of the volume of the social interaction based on a received user input.

15. The non-transitory computer readable medium as claimed in claim 9, further comprising refining the generated visualization of the volume of the social interaction based on a received user input.

* * * * *